US006062709A

United States Patent [19]

Cunnien et al.

[11] Patent Number: 6,062,709

[45] Date of Patent: May 16, 2000

[54] BULB RETAINER FOR ADJUSTABLE LAMP ASSEMBLY

[75] Inventors: Cole J. Cunnien, Novi; Eric A. Magda, Dearborn, both of Mich.

[73] Assignee: North American Lighting, Inc., Farmington Hills, Mich.

[21] Appl. No.: 08/975,821

[22] Filed: Nov. 21, 1997

Related U.S. Application Data

[60] Provisional application No. 60/036,314, Jan. 30, 1997.

[51] Int. Cl.[7] ..... F21V 29/00

[52] U.S. Cl. ..... 362/267; 362/519; 362/546

[58] Field of Search ..... 362/267, 519, 362/546, 548, 549, 457

[56] References Cited

U.S. PATENT DOCUMENTS

| | | | |
|---|---|---|---|
| 4,264,944 | 4/1981 | Deverrewaere | 362/61 |
| 5,327,330 | 7/1994 | Van Oel et al. | 362/61 |
| 5,442,525 | 8/1995 | Tsukada | 362/61 |
| 5,611,612 | 3/1997 | Choji | 362/546 |

FOREIGN PATENT DOCUMENTS

| | | | |
|---|---|---|---|
| 0 285 148 A2 | 3/1988 | European Pat. Off. . | |
| 0 300 482 A2 | 1/1989 | European Pat. Off. . | |
| 0 399 022 B1 | 10/1992 | European Pat. Off. . | |
| 0 253 243 B1 | 11/1992 | European Pat. Off. . | |
| 0 525 558 A2 | 2/1993 | European Pat. Off. . | |
| 0 626 293 A1 | 11/1994 | European Pat. Off. . | |
| 0 300 482 B1 | 12/1994 | European Pat. Off. | 362/546 |
| 0 643 256 A1 | 3/1995 | European Pat. Off. . | |
| 0646073 B1 | 4/1996 | European Pat. Off. . | |

*Primary Examiner*—Sandra O'Shea
*Assistant Examiner*—Peggy A. Neils
*Attorney, Agent, or Firm*—McDonnell Boehnen Hulbert & Berghoff

[57] ABSTRACT

The present invention relates to a lamp assembly comprising a housing member having an outer opening therein, wherein a reflector member is positioned substantially within said housing member, wherein the reflector member is adjustable and adapted with an inner opening into which a bulb member can be inserted. A protective member is provided which provides a substantial seal between the housing member and reflector member, wherein a retaining member for mounting the protective member to the reflector member is provided. The retaining member is adapted with portions to connect the protective member to the reflector and with portions to interlock corresponding members of the bulb member to the reflector member with relative ease.

6 Claims, 2 Drawing Sheets

BULB RETAINER FOR ADJUSTABLE LAMP ASSEMBLY

CROSS REFERENCE TO RELATED APPLICATIONS

This application claims the benefit of U.S. Provisional Application 60/036,314, filed Jan. 30, 1997.

FIELD OF THE INVENTION

The present invention relates to the field of electric lamp assemblies, and in particular, to an electric headlamp assembly for use in an automobile.

BACKGROUND OF THE INVENTION

Headlamp assemblies for automobiles typically include a housing with a lens and an opening therein for access to the lamp inside. The housing is typically mounted securely to the automobile or otherwise made a part of the automobile structure. An adjustable reflector is typically mounted within the housing for affixing a light bulb thereto. The light bulb is usually mounted to the rear of the reflector so that the light that emanates from the bulb is directed forward. By adjusting the position of the reflector in relation to the housing, the direction of the beam pattern emanating from the lamp assembly on the road can be adjusted.

When the light bulb requires replacing, access is provided to the rear part of the reflector through the outer opening of the housing. The outer opening is usually substantially aligned with the rear of the reflector so that easy access to the light bulb is possible. To protect the lamp assembly within the housing, however, the outer opening is typically sealed to prevent water, dirt and other debris, which could adversely affect the performance of the lamp, as well as the ability to adjust the reflector, from entering the housing. Such protection has been provided in the past by covering the entire rear assembly of the housing with a rubber boot. This has not been an entirely satisfactory solution, however, because the boot must be removed and reinstalled each time a spent light bulb is replaced.

Other attempts have also been made to seal the outer opening of the housing by extending a rubber boot-like member within the housing. For example, U.S. Pat. No. 4,264,944, issued to Deverrewaere, shows a headlamp assembly using a one-piece molded seal which seals the space between the outer shell and reflector. In addition, U.S. Pat. No. 5,327,330, issued to Van Oel et. al., shows a headlamp assembly having a flexible seal extending between the outer body and an inner lamp body. Moreover, U.S. Pat. No. 5,442,525, issued to Tsukada, shows a headlamp assembly wherein a sealing member is extended between the housing and a lamp bulb assembly.

While the previous attempts have been able to provide a seal for the outer opening, none of the previous attempts have been completely satisfactory. The manner in which the seal, for example, is manufactured, assembled and/or used, is complicated or otherwise not easy to accomplish in each case. In Deverrewaere, for instance, the molded seal must be form fitted and made snug with the reflector, making manufacture and assembly difficult. In addition, in Van Oel et. al., the flexible seal is connected with grooves and/or flanges and/or adhesives in the small space between the outer body and the forward part of the inner lamp body, making assembly difficult. Furthermore, in Tsukada, the sealing member is, among other things, connected around the base of the lamp fixture and connected to various surfaces on the housing, making assembly and use difficult.

What is needed, therefore, is a headlamp assembly for use in automotive lighting which provides a seal within the space between the housing and reflector, which is relatively easy to manufacture, assemble and use.

SUMMARY OF THE INVENTION

The present invention represents an improvement over previous headlamp assemblies for use in automotive lighting in that the present invention utilizes, in conjunction with a housing, reflector and light bulb, a single retainer for securing the bulb member and a flexible protective member to the reflector, wherein the protective member extends between the reflector and housing to form a seal therebetween. The protective member helps to prevent unwanted water, dirt and other debris from entering into the lamp assembly, while allowing direct access to the rear of the reflector to allow the light bulb to be easily replaced. In this respect, the same retainer used to secure the protective member to the reflector is used to secure the bulb member to the reflector, making the manufacture and assembly of the present invention relatively easy in comparison to previous assemblies. Moreover, the retainer allows the bulb member to be easily replaced without having to remove the protective member or any other connector or fastening device, making the present invention also easy to use.

Generally, the present invention comprises a housing having a lens and an outer opening therein, wherein an adjustable reflector is positioned substantially within the housing. The reflector has an inner opening for inserting a bulb member therein, which is accessible from the rear of the housing through the outer opening. The retainer of the present invention is preferably secured to the reflector on a raised portion thereof and used to secure the protective member and bulb member to the reflector. The raised portion preferably extends around the reflector's inner opening to enable both the protective member and retainer to be secured thereto. To connect the protective member to the reflector, the inner portion of the protective member is positioned between the retainer and raised portion, wherein one or more fasteners can be provided to secure the retainer and protective member to the raised portion. The outer portion of the protective member can also be secured to the housing, such as by form-fitting the protective member to the housing.

The retainer is also capable of engaging or otherwise interlocking with the bulb member such that the light bulb can be easily secured to the reflector. In this manner, the retainer can be used to secure both the protective member and bulb member to the reflector. In addition, the present invention contemplates using retainers that are capable of securing a variety of different types of bulb members having different connection mechanisms to the reflector. In one embodiment of the present invention, for example, the retainer has one or more inwardly directed retaining sections which engage and/or otherwise interlock with one or more tabs extending from the bulb member, such as bulb types 9005 and 9006. In this manner, a spent light bulb can be easily replaced by twisting off the old bulb member and twisting in the new bulb member. No other fasteners or connection devices are required. In another embodiment, the retainer can be provided with one or more tabs which extend outward to engage and/or otherwise interlock with corresponding openings on a locking member or ring provided on the bulb member, such as on the bulb type 9007. This embodiment also enables the light bulb to be easily replaced in like manner.

BRIEF DESCRIPTION OF THE DRAWINGS

FIG. 2A is a detail of the engagement between the reflector and retainer with the protective member in between;

DETAILED DESCRIPTION OF THE INVENTION

Figure 1:
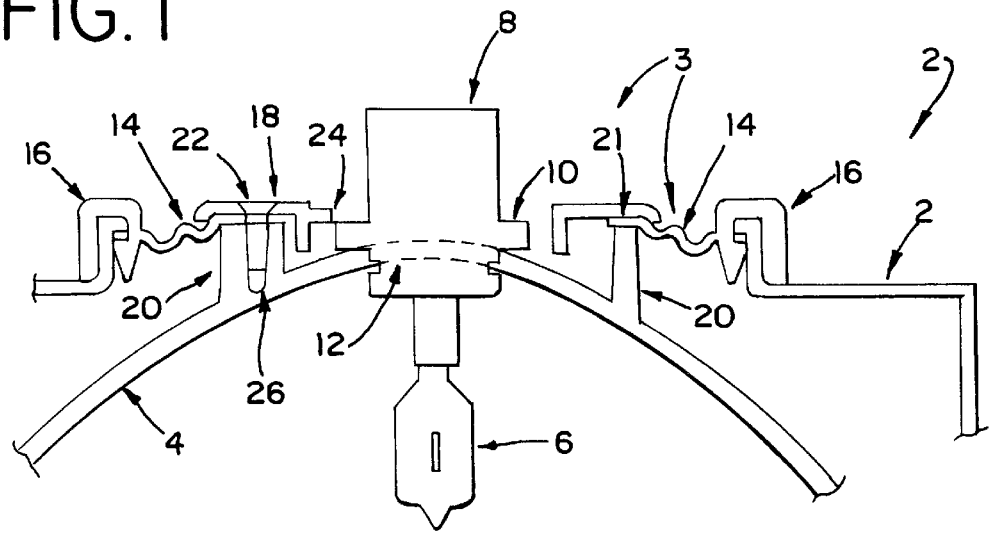
FIG. 1 is a cross section of the first embodiment of the present invention.

One embodiment of the present invention, as shown in FIG. 1, comprises using a headlamp assembly having a housing 2 with a lens (not shown) in the front portion thereof and an outer opening 3 substantially in the rear portion thereof. The housing 2 is typically provided within an automobile such that the lens faces the front of the automobile and the lamp is positioned to the rear of the housing such that light emanating from the lamp assembly is directed substantially forward through the lens. The housing 2 itself can be in virtually any shape or construction, so long as it is capable of being sealed to protect the lamp assembly inside, as will be discussed. The housing 2 can be separately formed and secured to the automobile, or otherwise made a part of the automobile structure.

As shown in FIG. 1, an adjustable reflector 4 is provided and mounted substantially within the housing 2. The reflector 4 is typically provided with a reflecting material on the inside surface which helps to direct light emanating from the lamp assembly in a predetermined direction and manner. The reflector 4 is preferably adjustable in relation to the housing 2 such that the direction of light emanating from the lamp assembly and therefore onto the road can be adjusted simply by adjusting the position of the reflector in relation to the housing 2.

The reflector 4 is provided with an inner opening 12 at or near the rear of the reflector into which a light bulb 6 and its base 8 can be inserted. The reflector 4 is preferably oriented within the housing such that the reflector 4 is substantially accessible from the rear of the housing through the outer opening 3. In this manner, easy access through the outer opening to the light bulb base 8 and inner opening 12 is possible, which enables the light bulb to be easily removed from the reflector and replaced.

A protective member 14, preferably made of a flexible material, which is impervious to water, like rubber, an elastomer, etc., is provided within the space between the reflector 4 and housing 2, to provide a substantial seal therebetween. Because the reflector 4 is adjustable, the protective member 14 is preferably flexible enough such that it does not interfere with or otherwise impede the adjustability of the reflector in relation to the housing. In this embodiment, the inner portion of the protective member 14 is secured to a raised portion 20 of the reflector which extends around the inner opening 12. While the raised portion preferably extends completely around the inner opening to help seal the space between the reflector 4 and housing 2, the seal can otherwise be provided, if desired, by adding additional material even if the raised portion were not extended completely around the opening 12.

An important aspect of the present invention is the retainer 18, which secures both the protective member 14 and bulb base 8 to the reflector. In this embodiment, the assembly of the present invention allows the inner portion of the protective member 14 to be positioned between the retainer and raised portion so that the protective member can be secured therebetween to provide a substantial seal against the entrance of water, dirt and other debris into the assembly. One or more fasteners 22, such as screws, bolts, etc., can be used to secure the retainer and protective member to the raised portion 20, thereby securing them to the reflector. When screws are used, which are the preferred fasteners, corresponding apertures 26 are provided on the retainer, raised portion, and protective member, such that the retainer and protective member can be easily secured to the raised portion using the same fasteners. That is, the protective member 14 has apertures 26 corresponding to the apertures in the retainer 18 and raised portion 20 such that screws 22 can be inserted through the retainer 18 and protective member 14 and then into the raised portion 20.

Figure 3:
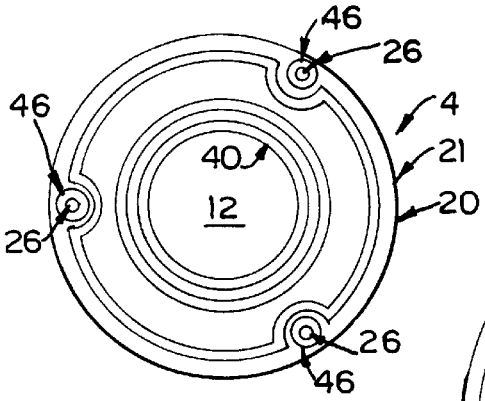
FIG. 3 is a partial end view of the reflector assembly shown in FIG. 2.
Figure 4:
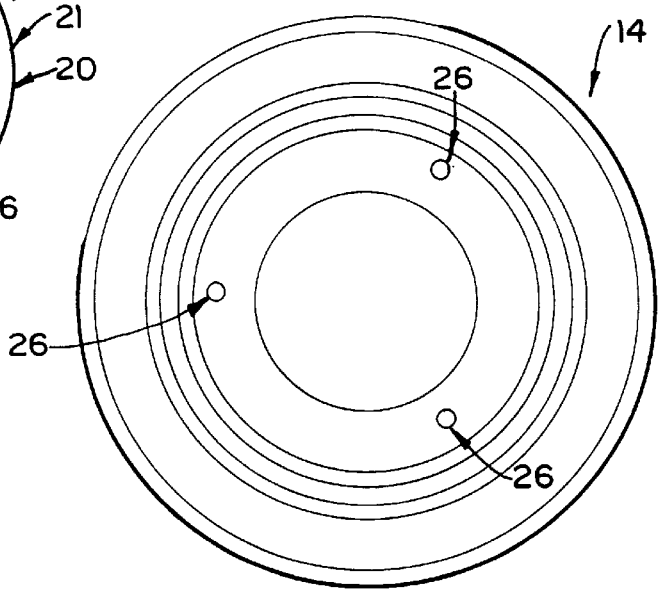
FIG. 4 is a plan view of the protective member in accordance with the present invention.

Three screws are preferably provided, as shown in FIG. 3, and oriented within the apertures so that they can be easily installed through the outer opening 3 from the rear of the assembly. In this manner, the protective member 14 and retainer 18 are preferably easily installed onto the reflector, i.e., by placing the protective member 14 directly onto the raised portion 20, placing the retainer 18 onto the protective member, and then securing them to the reflector by lining up the apertures, inserting the screws into the apertures and tightening them into position.

The raised portion 20 is preferably raised to allow the screws 22 to be received within the apertures 26 without the apertures penetrating through the reflector to the other side. This helps to avoid creating additional openings in the reflector that would require sealing. Another advantage of the raised portion is to provide easy access to the protective member and retainer so that they can be easily secured to the reflector through the outer opening 3. The entire mounting surface, however, does not have to be raised above the surface of the reflector, according to the present invention, so long as the surface allows the retainer and protective member to be secured and substantially sealed thereto.

The raised portion 20 has a top surface 21 on which the protective member can be positioned and secured. The top 21 of the raised portion and/or the under surface of the retainer 18 can be configured such that the protective member can be securely positioned between the retainer 18 and raised portion 20. For example, ridges 27 or other deformations, as will be discussed in conjunction with the embodiment of FIG. 2, can be provided on those surfaces to help secure the protective member 14 in place.

The outer portion of the protective member 14 is secured to the housing 2, preferably along or near the edge of the outer opening 3. The outer portion of the protective member 14 can be secured to the housing 2 by any conventional means, although the preferred method is to mold the protective member in a manner that allows it to be form-fitted and/or inter-locked with the housing, as shown in FIG. 1. By extending the protective member 14 within the space between the reflector and housing, and more specifically, between the raised portion 20 and inside edge of the outer opening 3, the protective member substantially seals the space between the reflector and housing to prevent dirt, water and other debris from entering into the assembly. To reduce the space between the reflector and housing, the outer opening 3 is preferably only slightly larger than the perimeter of the raised portion 20. The space, nevertheless, is preferably sufficient to enable the reflector to be fully adjustable in relation to the housing.

In the embodiment of FIG. 1, the bulb base 8 has extended tabs 10 which mate and/or otherwise interlock with inwardly extended sections 24 on the retainer 18. The inwardly extended sections 24 are designed to engage the extended tabs 10 in order to hold and secure the bulb base, and therefore, the bulb 6, within the inner opening 12. Because the retainer is secured to the raised portion 20, as discussed above, the bulb base 8 can be secured to the reflector by causing the extended tabs 10 to interlock with the inwardly extended sections 24. In this manner, the retainer 18 can secure both the protective member 14 and bulb base 8 to the reflector. The extended tabs 10 on the bulb base 8 also preferably provide a stop, although not necessarily so, for the penetration of the bulb base into the inner opening 12. In this respect, the inside edge of the inner opening 12 is preferably designed to substantially mate with the corresponding portion of the bulb base 8, such that they provide a substantial fit therebetween.

In the embodiment of FIG. 1, the members which comprise this portion of the lamp assembly, including the inner opening 12, outer opening 3, protective member 14, raised portion 20, bulb base 8 and retainer 18, are annular in shape. In this manner, the annular bulb base 8 can be inserted into the annular inner opening 12 and then twisted such that the extended tabs 10 can be interlocked with the inwardly extended sections 24. While this embodiment comprises annular shaped members, the members of the assembly, in particular the outer opening 3, protective member 14 and raised portion 20, do not necessarily have to be annular in shape.

The retainer 18 and bulb base 8 can be made of any substantially rigid and durable material, such as plastic, which provides the benefits discussed herein. The reflector 4 and housing 2 can be also be made of any substantially rigid and durable material, such as metal, plastic, etc.

In a second embodiment of the present invention, as shown in FIGS. 2–6, different types of interlocking members are provided to accommodate different types of bulb members. Indeed, the present invention contemplates using a variety of different types of connecting members to allow various types of bulbs 6 and bulb bases 8 to be secured to the reflector 4. The second embodiment uses a retainer 28 which, like the first embodiment, secures both the protective member 14 and bulb base 8 to the reflector. As in the first embodiment, the retainer 28 preferably has one or more apertures 26 into which fasteners or screws 22 can be inserted to secure the retainer 28, with the protective member in between, to the raised portion 20.

Figure 5:
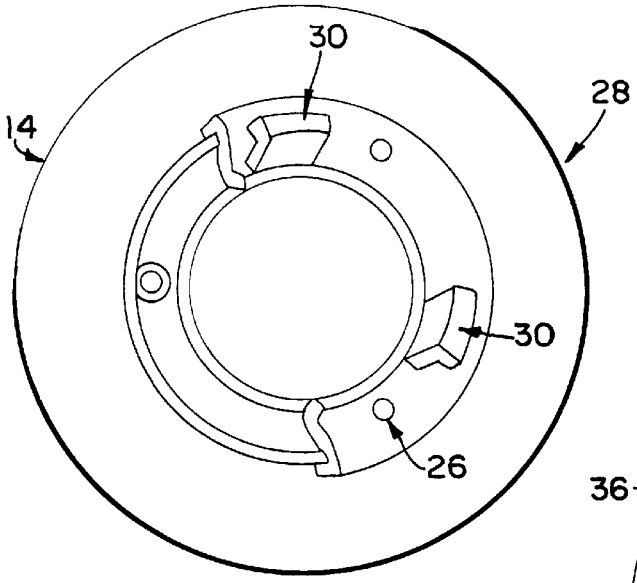
FIG. 5 is a perspective view of the retainer of the embodiment shown in FIG. 2.
Figure 6:
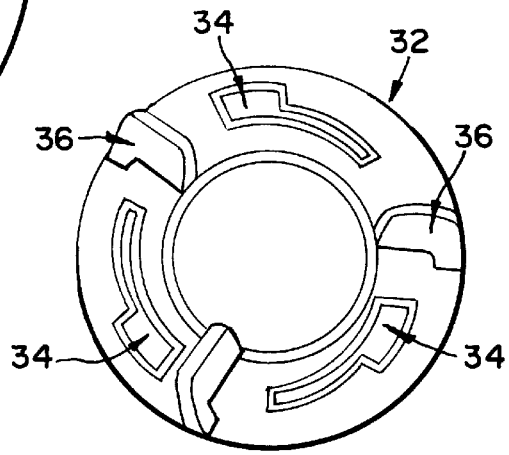
FIG. 6 is a perspective view of a bulb locking ring to be used in conjunction with the retainer shown in FIG. 5.

In the second embodiment shown in FIGS. 2 through 6, the assembly comprises a bulb base 8 with a locking member or ring 32, as shown in FIG. 6, having one or more openings 34 for receiving locking tabs 30, as shown in FIG. 5, that extend from the retainer 28. While the retainer 28 in the second embodiment is similar to the retainer 18 in the preferred embodiment, locking tabs 30 extend outward and rearward, in relation to the assembly, rather than inward, as in the first embodiment. The locking tabs 30, as shown in FIG. 5, are configured such that they will be received in the openings 34. Thereafter, the locking ring 32 can be twisted to interlock the tabs 30 with the openings 34 to connect the bulb base 8 to the reflector 4. It should be understood, however, that the present invention can be applied to other structures such as one where the locking tabs 30 are on the locking ring 32 and corresponding openings 34 are on the retainer 28. One or more levers 36 extended from the locking ring 32 facilitate the twisting of the locking ring in relation to the retainer to secure the bulb base into place.

Figure 2A:
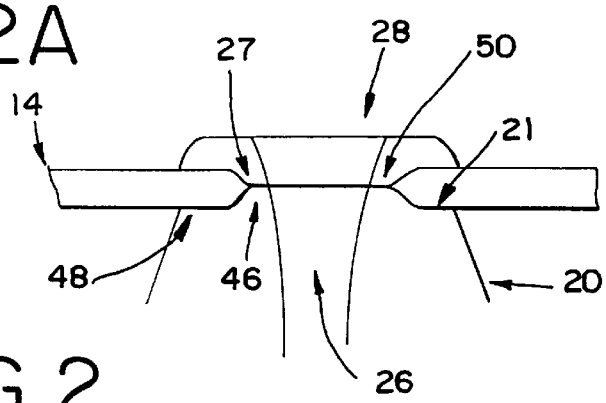
Figure 2:
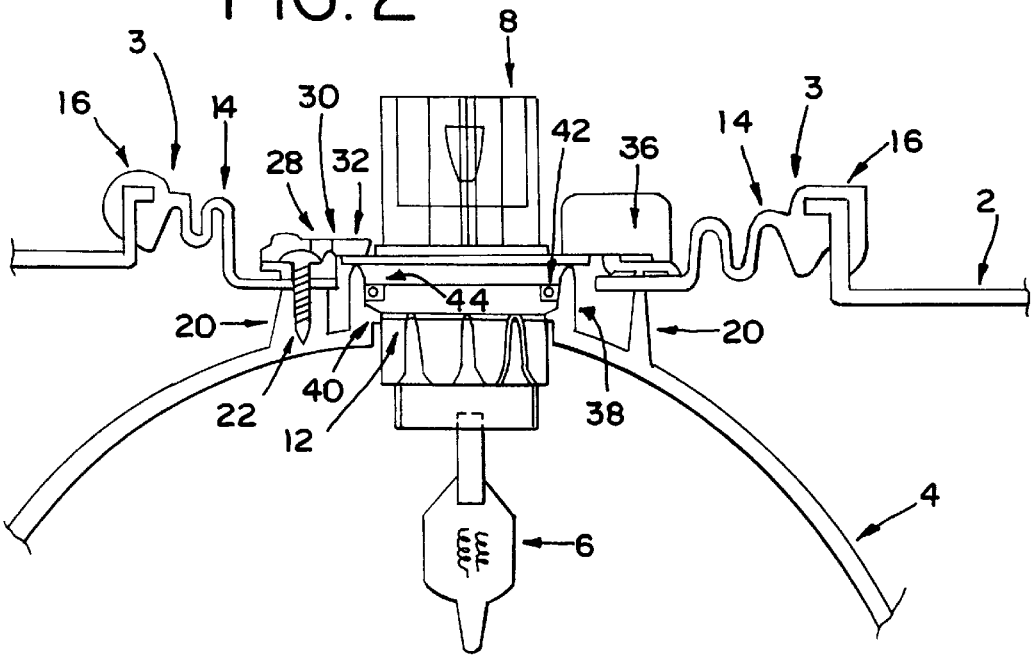
FIG. 2 is a cross section of the second embodiment of the present invention.

As shown in FIG. 2A, in either the embodiment shown in FIG. 1 or 2, the top 21 of the raised portion 20 can have one or more ridge portions 46 extending further outward to provide a seat for the retainer. A corresponding ridge portion 50 can also be provided on the retainer for engaging the raised portion. The ridge portion 46 can be provided on top 21 of the raised portion 20, and ridge portion(s) 50 can be provided on the underside of the retainer 28, wherein both ridge portions 46 and 50 are provided around the apertures 26 of the raised portion and retainer, respectively, to enable the retainer to be securely positioned on the raised portion 20. This enables the protective member 14 to be positioned substantially between the retainer 28 and raised portion 20 on areas 48 not having any ridge portions. In this respect, the protective member 14 can be clamped between the areas 48 on the raised portion and retainer.

In the embodiment shown in FIG. 2, a second raised portion 38 is provided around the inside edge of the inner opening 12. The second raised portion 38 is designed to engage the bulb base 8 to securely mount it to the reflector and provide a seal therebetween. In one version of the second embodiment, an annular lip 40 is provided on the inside edge of the second raised portion 38 for engaging a flexible gasket member 42 to substantially seal the space between the bulb base and second raised portion 38. The bulb base 8 is provided with a complimentary annular shelf 44 which helps to position the gasket 42 between the bulb base and second raised portion 38, and between the annular lip 40 and annular shelf 44. In this manner, as the bulb base is tightened onto the second raised portion 38, the gasket 42 helps to substantially seal the inner opening 12 of the reflector 4. The gasket can be made of various conventional materials, such as rubber, etc.

The assembly of the present invention allows the protective member 14 to be easily installed through the outer opening by simply securing the retainer 18 or 28 to the reflector with the protective member between the raised portion and retainer. The present invention allows the lamp assembly to be easily assembled by positioning the protective member 14 onto the raised portion 20, positioning the retainer 18 or 28 onto the protective member and then inserting the screws 22 into the apertures 26 such that the protective member 14 is secured therebetween. The form-fitted outer portion of the protective member 14 can also be used to easily secure the outer portions of the protective member to the housing 2. In addition, the present invention is easy to use because the light bulb 6 and base 8 can be replaced easily without having to remove any other component of the assembly. In this respect, the present invention contemplates using various types of retainers and interlocking and/or connecting members to be used to enable various types of light bulbs and bulb bases to be easily fastened to the reflector without having to use separate fasteners or other connecting devices.

While specific embodiments are discussed herein, it is understood that other embodiments which have not been shown which nevertheless provide the advantages discussed herein, are within the contemplation of the present invention.

What is claimed is:

1. A lamp assembly comprising:

a housing member having a first opening therein;

a reflector member positioned substantially within said housing member, said reflector member having a second opening that is adapted such that a bulb member can be inserted therein and having a raised portion that extends substantially around said second opening, and wherein a flexible member is secured to the raised portion;

said flexible member connected to the housing member and the reflector member, and extending substantially between said first opening and said second opening, creating a substantial seal therebetween; and a retaining member for securing the flexible member and bulb member to the reflector member, wherein the flexible member is positioned between the retaining member and raised portion, such that the flexible member is secured therebetween to the reflector member.

2. The lamp assembly of claim 1, wherein the retaining member is secured to the raised portion with one or more fasteners.

3. The lamp assembly of claim 1, wherein the top of the raised portion has a section with one or more extended ridges thereon to provide a seating onto which the retaining member can rest, and wherein the top of the raised portion has a section without an extended ridge thereon, such that the flexible member can be secured to the reflector member between the retaining member and the section of the raised portion without an extending ridge thereon.

4. The lamp assembly of claim 1, wherein the underside of the retaining member has a section with one or more extended ridges thereon for engaging said raised portion, wherein the underside of the retaining member has a section without an extended ridge thereon, such that the flexible member can be secured to the reflector member between the raised portion and the section of the retaining member without an extended ridge thereon.

5. The lamp assembly of claim 1, wherein a raised edge portion is provided substantially around the edge of the second opening, said raised edge portion having an annular lip capable of supporting a gasket member to provide a seal between the bulb member and said second opening.

6. A retainer for use in a lamp assembly comprising a body portion having at least one opening therein, said body portion having an upper side and an underside wherein said underside is adapted to enable a protective member to be secured to and substantially sealed with a reflector located substantially within a housing of said lamp assembly the body portion adapted to enable a bulb member to be inserted through the opening and secured to said reflector, the body portion having one or more apertures for insertering one or more fasteners therethrough, wherein said fasteners can be used to secure the protective member and body portion to the reflector, wherein the pretetive member is positioned substantially between said body portion and reflector;

wherein one or more extended ridge portions are provided on the underside of the body portion, wherein the ridge portions extend substantially around said one or more apertures, and are adapted to engage a raised portion of the reflector, wherein the protective member can be substantially secured to the reflector between an area of the underside not having any ridge portions thereon and a corresponding portion of the raised portion.

* * * * *